United States Patent [19]

Ortal

[11] 4,331,239

[45] May 25, 1982

[54] PACKAGE FOR COSMETICS AND PERFUMES

[75] Inventor: Raymond Ortal, Dauphine, France

[73] Assignee: Societe STENDHAL S.A., France

[21] Appl. No.: 87,018

[22] Filed: Oct. 22, 1979

[30] Foreign Application Priority Data

Feb. 13, 1979 [FR] France ..... 79 04200
Jun. 13, 1979 [FR] France ..... 79 15872

[51] Int. Cl.[3] ..... B65D 1/30; B65D 3/24

[52] U.S. Cl. ..... 206/581; 132/79 R; 215/6; 220/23

[58] Field of Search ..... 206/581; 132/79 R, 79 F; 215/6, 364; 220/4 E, 4 B, 23, 4 C, 4 D

[56] References Cited

U.S. PATENT DOCUMENTS

| | | | |
|---|---|---|---|
| 1,598,365 | 8/1926 | Clarke | 132/79 R |
| 2,328,338 | 8/1943 | Hauptman | 215/12 R |
| 2,396,932 | 3/1946 | Slaton | 220/23 |
| 2,663,450 | 12/1953 | Bouvart | 206/581 |
| 2,940,589 | 6/1960 | Silverman | 220/4 D |
| 3,067,896 | 12/1962 | Berg | 220/4 D |
| 3,079,022 | 2/1963 | Tompkins | 215/6 |
| 3,459,294 | 8/1969 | Crosman | 206/45.19 |
| 3,469,739 | 9/1969 | Phillips | 215/6 |
| 4,101,041 | 7/1978 | Mamo | 215/6 |

FOREIGN PATENT DOCUMENTS

| | | | |
|---|---|---|---|
| 884140 | 12/1961 | United Kingdom | 220/23.83 |

*Primary Examiner*—Herbert F. Ross
*Attorney, Agent, or Firm*—Prutzman, Kalb, Chilton & Alix

[57] ABSTRACT

A package is provided for cosmetic bottles or the like. The package joins two bottles together one above the other by attachment to the stopper of the lower bottle and the base of the upper bottle. The device comprises a pair of complementary mating bottom shell portions which, when assembled, provide a first cavity for firmly engaging the stopper of the lower bottle and a second overlying cavity for retainably enclosing the base of the upper bottle. The packaging device includes a cap composed of a base element having a cylindrical compartment for receiving the stopper of the upper bottle and a cover plate element enclosing said compartment.

6 Claims, 15 Drawing Figures

PACKAGE FOR COSMETICS AND PERFUMES

The present invention relates to cosmetic and perfume products and more particularly to the packaging of cosmetics and perfume.

The current commercial practice of large cosmetic and perfume companies is to place on the market a "line" of products rather than isolated individual products. In this connection such a line of products may include perfume and toilet water that are related in that they are of the same fragrance or essence with the toilet water being more diluted than the perfume. Consequently there is a practical reason for being able to sell as well as buy a perfume and its related toilet water together at the same time. Presently the two products are sold in separate bottles. Besides the necessity of making two separate purchases, there is the risk that the retailer will run out of stock on one of the products, perfume or toilet water, and the difficulty that for the buyer will not be able to find the combination that he or she is looking for.

The present invention has for its purpose a device that provides for joining together two bottles in such a way that they form, when fitted together, a unit of sale.

According to the invention, this result is obtained by providing a device for joining together two bottles by arranging them one above the other. The device is characterized in that it adapts itself to the stopper of the lower bottle and encloses the base of the upper bottle so as to be united with the latter.

The manner in which the device adapts itself to the lower bottle can be varied but all relate essentially to the form of the stopper. According to a preferential embodiment of the invention, the adaptation on the stopper of the lower bottle will consist of a female element corresponding to the form of the stopper with the stopper fitted within the element. For a cylindrical stopper, the female element will consist of a casing or sleeve in which the stopper of the lower bottle will be snugly arranged. For reasons of standarization in same products it is expected of course that the lower bottles of diverse shapes all will have identical stoppers.

The means for enclosing the base of the upper bottle and joining together of the device according to the invention result in every case from the cooperation of the base of said bottle with appropriate means on the device of such a sort that, once the bottle is joined together with the device, the bottle is held in a substantially firm manner united with the device. According to a preferred embodiment of the invention, there is provided a neck portion on the base of the upper bottle under the supporting part of said bottle. The base cooperates with a cavity of the device having an inlet whose circumference encloses the base of the bottle along its entire neck portion.

The body of the device consists of the assemblage of two or more, but preferably two distinct parts or shells whose joining will enclose the base of the upper bottle, each of the two parts being equipped with means allowing it to interfit with the other. Preferentially, the body will comprise two identical shells which when assembled also have a first portion enclosing the casing or sleeve for the stopper of the lower bottle and another portion positioned around the neck of the base of the upper bottle.

As can be appreciated the reduced diameter neck on the base of the upper bottle need not extend around the entire circumference of the bottle. In practice, the neck is obtained by providing a base having a flared form in relation to the body of the bottle itself.

With a view toward standardization for the upper bottles of variable shapes and also in order to provide the best possible gripping of the assembly including the two bottles joined by the device of the present invention, the upper bottle may be equipped with a stopper always having substantially the same dimensions for joining a generally egg-shaped cap to the assembled shells of the device.

One will better understand the invention with the aid of the following description in which.

Figure 2A:
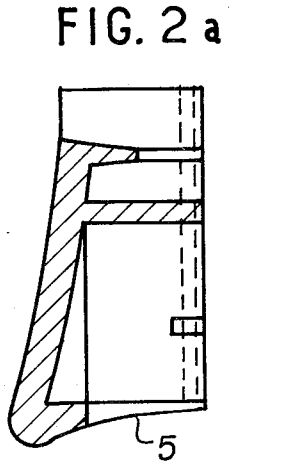
FIG. 2 is a side view of one bottom shell of the device of FIG. 1.
Figure 3B:
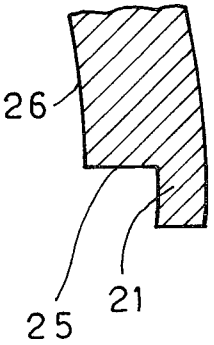
Figure 3A:
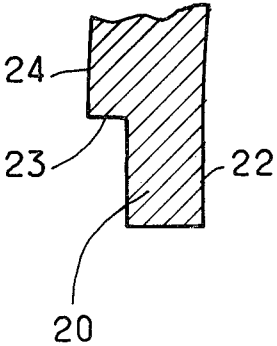
Figure 2:
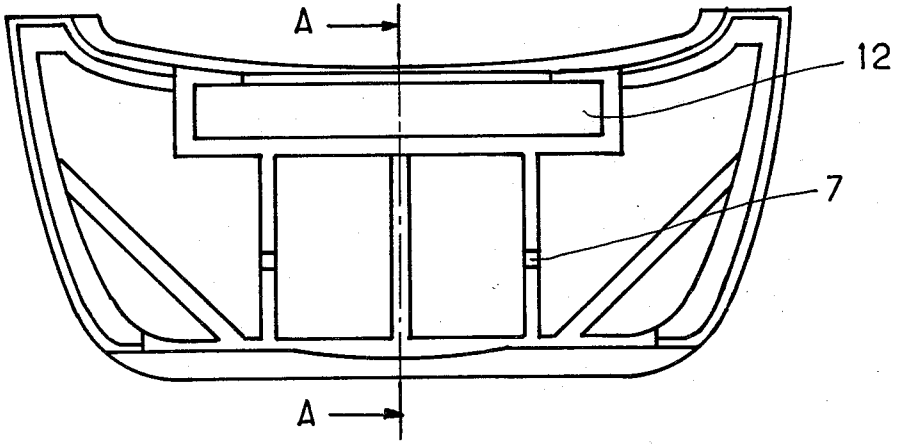
Figure 3:
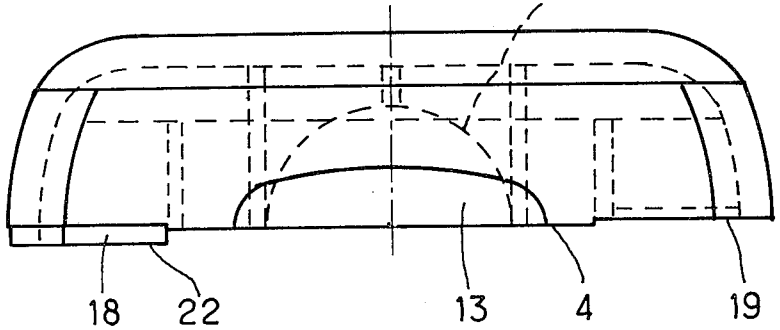
Figure 4C:
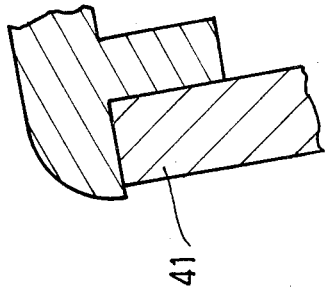
Figure 4B:
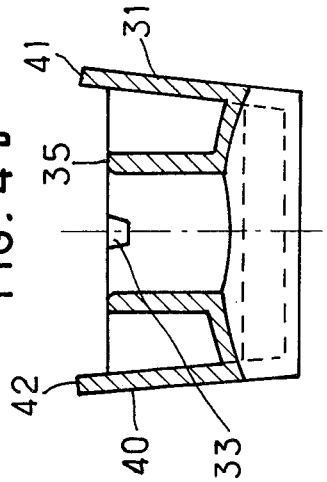
Figure 4:
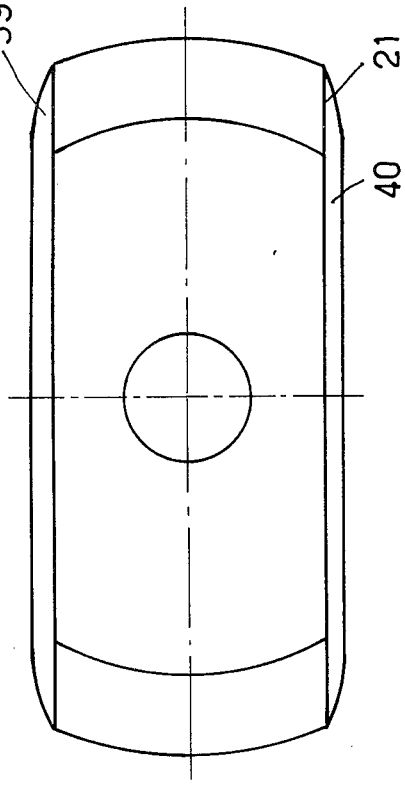
Figure 4A:
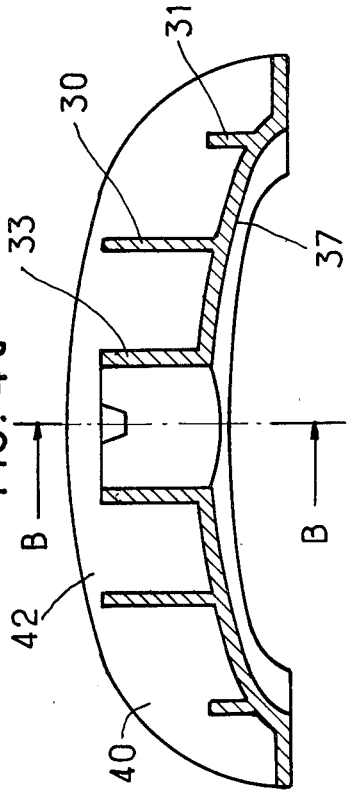

FIG. 2*a* is a sectional view taken along the line AA of FIG. 2;

FIG. 3 is a top view of the shell of FIG. 2;

FIGS. 3*a* and 3*b* show the details of the interconnection between the two bottom shells of the device;

FIG. 4 is a view of the underside of the lower part of the cap;

FIG. 4*a* is a longitudinal sectional view of the same lower part of the cap;

FIG. 4*b* is a transverse sectional view taken along the line BB of FIG. 4*a;*

Figure 5:
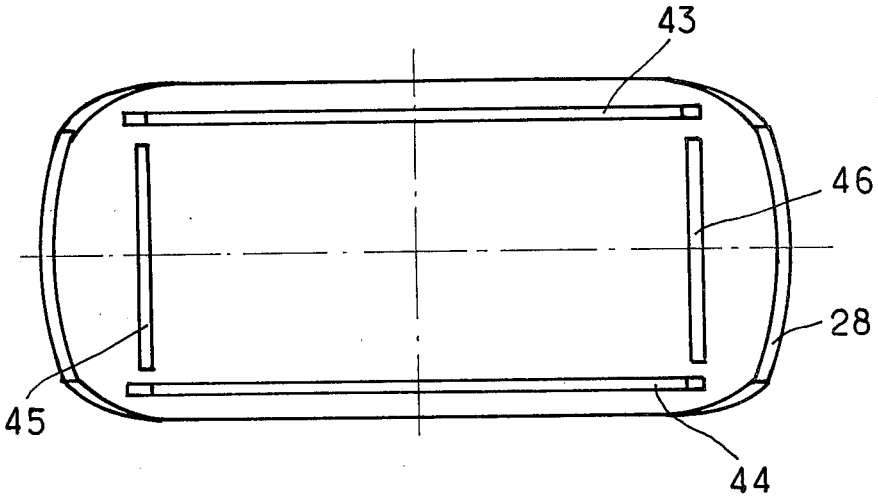
Figure 6:
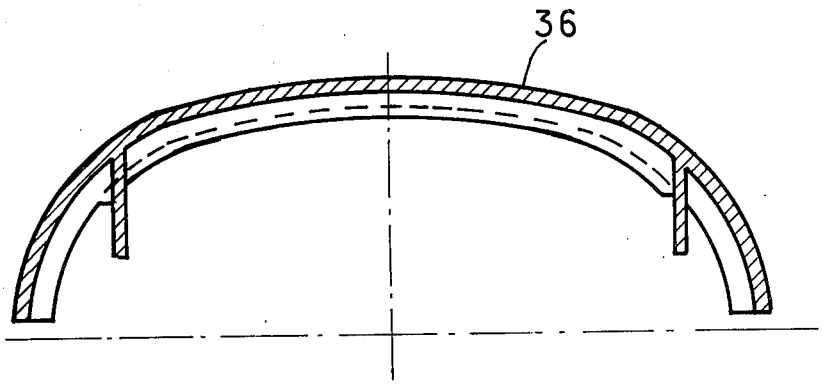

FIG. 4*c* is a detail of the interconnection between the lower part and the upper part of said cap;

FIG. 5 is a view of the underside of the upper part of the cap;

FIG. 6 is a longitudinal sectional view of the upper part of the cap.

Figure 1:
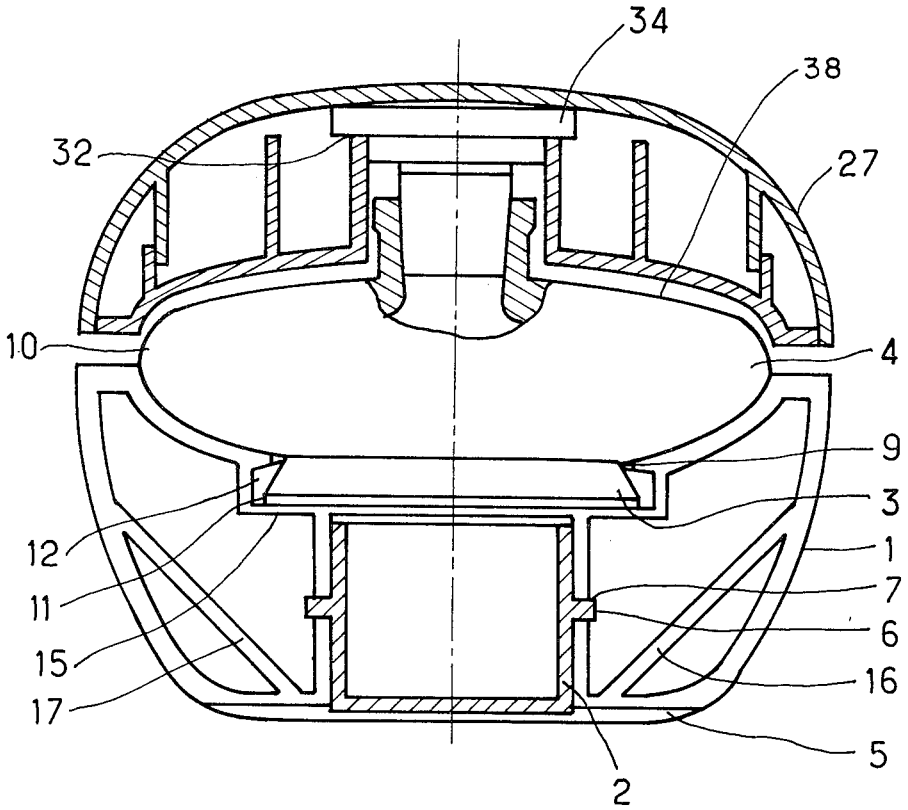
FIG. 1 is an elevational view of the device in cross section with the upper bottle mounted therein.
Figure 7:
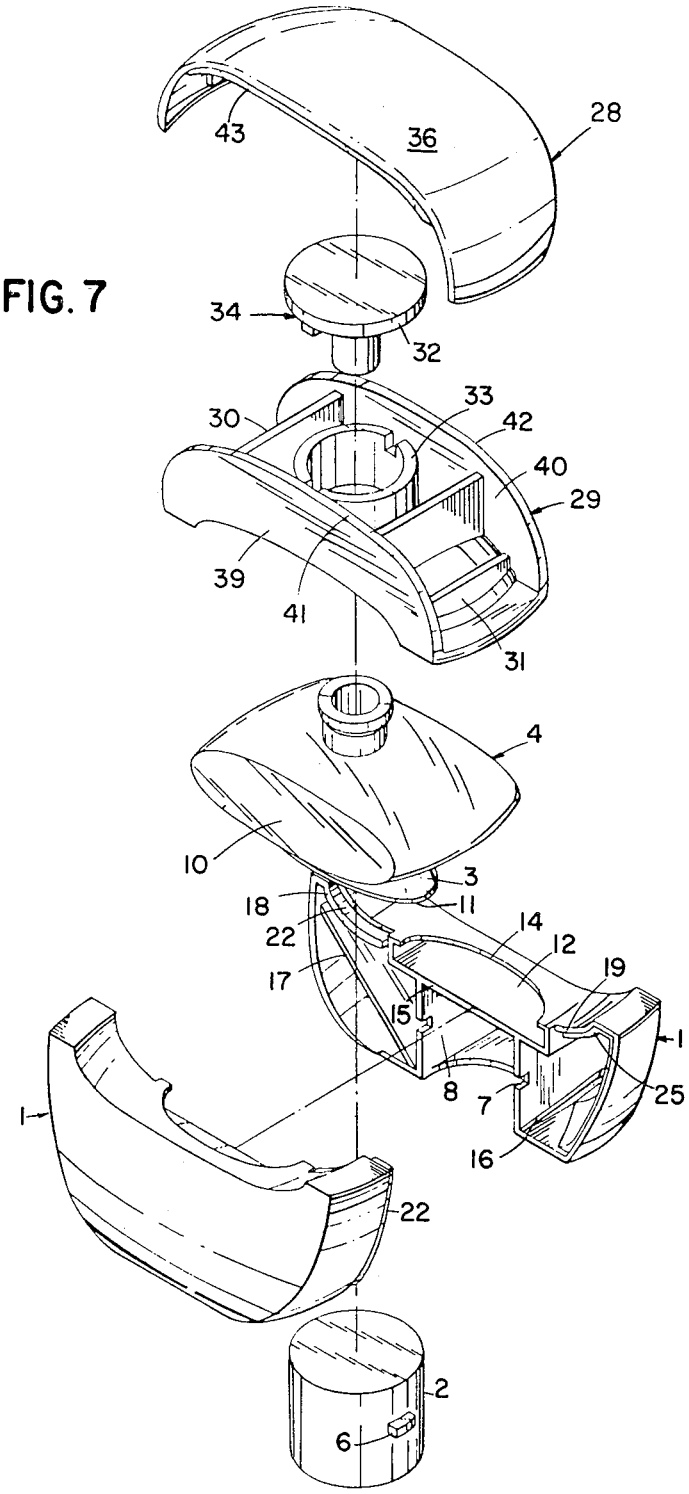
Figure 8:
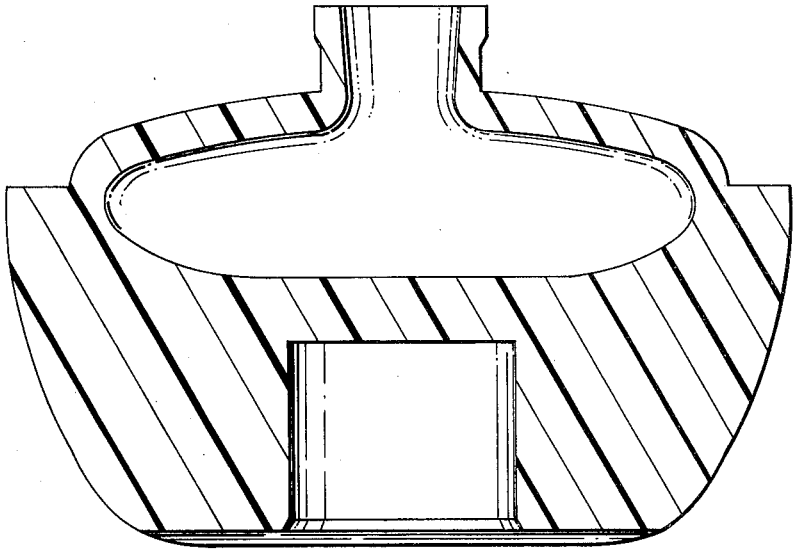
Figure 9:
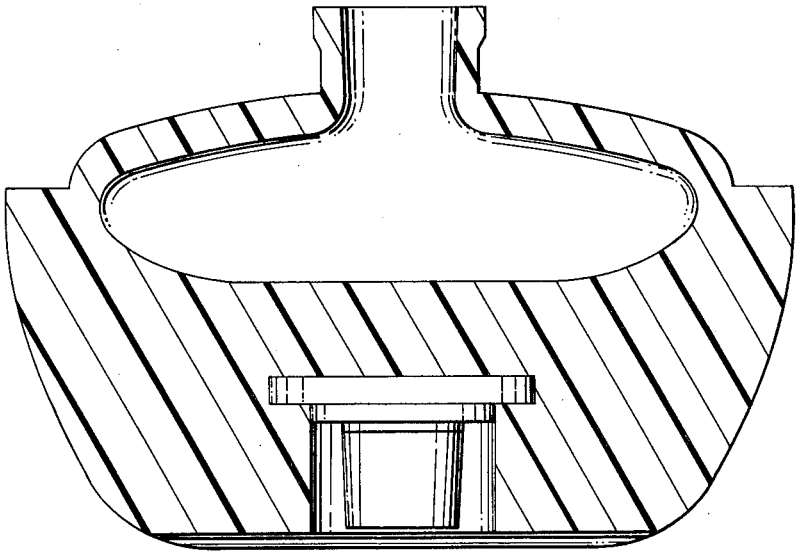

FIG. 7 is an exploded perspective view of the device of FIG. 1;

FIG. 8 is a cross sectional view of an alternative embodiment showing the bottom shell and upper bottle as an integral one-piece unit; and FIG. 9 is a cross sectional view similar to FIG. 8 showing another alternative embodiment.

The device according to the invention is comprised of two hollow bottom shells 1 which when assembled encloses a sleeve or casing 2 for the stopper of a lower bottle (not shown) and the base 3 of an upper bottle 4.

The sleeve 2 provides a snug or friction fit on the stopper of the lower bottle. For better stability of the assemblage supported by the stopper of the lower bottle, the shell's bottom surface 5, providing the supporting part of the device when in contact with the lower bottle, is curved to conform to the top of the lower bottle. The sleeve 2 is prevented at the same time from rotation and translational movement in each of the two shells simultaneously by the intermediary of two or several stops 6 which cooperate with ridges or notches 7 arranged on the edge of a hemi-cylindrical compartment 8 of the shells 1.

On the base 3 of the upper bottle 4 is arranged a narrowed neck portion 9 preferable along the entire circumference of said base, for example in an elliptical form. The neck 9, arranged between the body 10 of the bottle and and the supporting part 11 of the base is obtained in practice by giving to the supporting part 11 a widened or flared form at its lowermost point. The neck 9 cooperates with a cavity 12 formed by joining the two shells within which is positioned the base 3 of the bottle. The cavity is provided with a reduced size opening 13 whose circumference 14 fits into the recess provided by the neck 9, thus preventing the displacement of the upper bottle through the top of the cavity. The interconnection of the two shells is such that they prohibit the lateral displacement of the upper bottle.

For better stability of the assembly and in order to avoid supporting all the weights of the upper bottle 4 by the single circumference 14, the supporting part 11 of the bottle's base will rest on and be supported by a horizontal wall 15 of the shells which constitutes the bottom of the cavity 12 and against which is equally supported the bottom of the sleeve or casing 2.

In order to obtain maximum rigidity of the shells, one can preferably provide some interior walls 16, 17 inclined at approximate 45° and acting as stiffening abutments.

The device according to the invention is obtained by joining the two identical shells that are strictly symmetrical with relation to a plan, to the exclusion of edges 18 and 19 that provide some complementary connectors such as at 20 and 21. The edge 18 is provided with a tongue 22 projecting from the face of the shell adjacent the exterior surface 24 and spaced therefrom by continuous groove 23. In corresponding manner, the edge 19 is provided with a continuous groove 25 arranged on the internal surface 26 of said edge for receiving a tongue 22 on a complimentary shell.

The cooperation of an edge 18 of one shell with an edge 19 of another shell assures the junction and effective joining together of the two shells and provides for the locking of the sleeve 2 and of the upper bottle 4, preferably with the utilization of paste.

The device equally comprises a canope or cap 27, composed of two interfitting elements, an upper element 28 and a lower element 29, the canope being symmetrical with relation to a longitudinal plan and a transverse plan.

The lower element 29 is equipped with vertical internal walls such as 30, 31 in a manner to limit the crushing of said element. It equally comprises in its central part a cylindrical sleeve-like wall 33, the stopper 34 of the upper bottle being arranged in this sleeve and being supported on the free end 35 of said wall 33. The stopper is blocked in position by the upper element 28 of the cap 27 and by some stops arranged on the head 32 of the stopper for cooperating with some ridges or notches in the wall 33.

The upper element 28 is comprised essentially of a cover plate 36 having a semi-elliptical profile. The lower element 29 is composed of a base 37 conformed in a way to envelop the upper part 38 of the bottle 4 and a pair of diverging sides 39, 40 whose free edges 41, 42 have the same semi-elliptical form as the cover plate 36.

Assembly of the two elements 28 and 29 to form the cap is provided along the length of the free edges 41 and 42 by means of longitudinal embossments 43, 44 and by transverse embossment 45, 46, all arranged on the internal face of the plate 36. The transverse embossments cooperate on contact with the walls 31, while the longitudinal embossments are in contact with and are arranged between the sides 39 and 40 as shown in FIG. 4*c*.

Preferably, the shells will be made of ABS, while the cap will be formed from acetate. Finally, the sleeve 2 will be of polyethylene.

As can be appreciated, if the upper bottle is used with its two shells, without the lower bottle, the sleeve 2 can be inverted so that the opening is around the top, as shown in FIG. 1.

It is also contemplated that the device can be made an integral part of the upper glass bottle and molded with the latter as exemplified in FIGS. 8 and 9. In this way the bottom of the upper bottle presents a full part in the center of which is arranged a female orifice destined to receive the stopper of the lower bottle.

As another alternative, in inverse manner, arranged on the base of the upper bottle is a cylindrical male part that can be fitted in the stopper or form the stopper for the lower bottle. However, in order to be able to utilize the upper bottle alone and rest it on a flat surface at the time of utilization, the bottom of the bottle can be equally equipped with a skirt surrounding the said male part, providing at the same time the functions of foot and of camouflage for the stopper of the lower bottle. Of course, it is necessary for this effect that the height of this skirt be slightly higher than that of the male cylindrical part.

I claim:

1. A device for joining together two bottles one above the other by attachment to a stopper of the lower bottle and a base of the upper bottle comprising a pair of complementary mating bottom shell portions suited for assembly in face to face relationship and a pair of complementary canope portions supporting a stopper for the upper bottle, said shells when assembled providing a first central cavity having means for firmly engaging the stopper of the lower bottle and a second central cavity overlying and separated from said first cavity for retainably enclosing the base of the upper bottle and securing said base against removal from said second cavity during use of the upper bottle, said canope portion enclosably retaining the stopper for the upper bottle and extending therebeyond to overlie the upper bottle and the mating bottom shell portions.

2. The device of claim 1 wherein said second cavity is provided with an inlet of reduced circumference for enclosably securing and retaining the base of the upper bottle positioned within said second cavity.

3. The device of claims 1 or 2 wherein the mating shells are substantially identical and include complementary interfitting means for joining the two shells together in secure mated relationship.

4. The device of claim 1 including a cap covering said shells and retainably supporting a stopper for the upper bottle.

5. The device of claim 4 wherein the cap is composed of a base element having a cylindrical compartment for receiving said stopper and a cover plate element for the base element enclosing said compartment.

6. The device of claim 5 wherein the base element is provided with upstanding walls and the internal face of the cover plate element is provided with embossments engageably cooperating with said walls to interconnect the base element and cover plate element of the cap.

* * * * *